US005348393A

United States Patent [19]

Pappas, Jr.

[11] Patent Number: 5,348,393

[45] Date of Patent: Sep. 20, 1994

[54] SAFETY GUARD SYSTEM FOR FOOD MIXER

[75] Inventor: Phillip M. Pappas, Jr., Danville, N.H.

[73] Assignee: Univex Corporation, Salem, N.H.

[21] Appl. No.: 919,039

[22] Filed: Jul. 24, 1992

[51] Int. Cl.[5] ..... B01F 7/00

[52] U.S. Cl. ..... 366/207; 366/212; 366/284; 366/347; 366/603

[58] Field of Search ..... 366/92, 142, 77, 189, 366/207, 212, 225, 233, 248, 279, 281, 284, 603, 347

[56] References Cited

U.S. PATENT DOCUMENTS

| | | | |
|---|---|---|---|
| 1,767,002 | 6/1930 | Johnston et al. | 366/207 |
| 1,781,321 | 11/1930 | Dehuff | 366/207 |
| 1,853,589 | 4/1932 | Walker | 366/279 |
| 2,014,734 | 9/1935 | Hoe | 366/347 |
| 2,181,079 | 11/1939 | Dehuff | 366/142 |
| 2,306,245 | 12/1942 | Duke | 366/248 |
| 2,621,907 | 12/1952 | Maurer et al. | 366/207 |
| 3,450,179 | 6/1969 | Golding | 366/279 |
| 3,749,373 | 7/1973 | Kemper | 366/77 |
| 3,875,423 | 4/1975 | Kemper | 366/142 |
| 4,113,188 | 9/1978 | Belinkoff | 241/37.5 |
| 4,765,746 | 8/1988 | Puig . | |
| 4,968,149 | 11/1990 | Loiselet et al. | 366/189 |
| 5,071,077 | 12/1991 | Arroubi et al. | 366/347 |
| 5,207,506 | 5/1993 | Musseau et al. | 366/77 |

FOREIGN PATENT DOCUMENTS

| | | | |
|---|---|---|---|
| 0814583 | 8/1951 | Fed. Rep. of Germany | 366/207 |

OTHER PUBLICATIONS

A product sheet of Santos showing a food mixer having a protective screen, 10 Liters Mixer No. 27.

A product sheet of Hobart Food Equipment, "New Hobart Spiral Mixers–All the Benefits of Spiral Mixing Combined with Hobart Quality", for a food mixer having a protective screen.

A cover from a product sheet of Esmach showing a food mixer having a protective screen, Impastatrice ISE/60F.

A product sheet of Dito Sama showing a pair of food mixers, both having protective screens.

A cover from a product sheet of GB Macchine showing a food mixer, Mixer AE, having a protective screen.

An advertisement of APV Pavaller Inc., entitled "3 Winning Choices for Baking Perfection!", from Modern Baking, May, 1992, p. 28., showing a food mixer having a protective screen.

A product sheet (Code 908) of Gemini, Philadelphia, Pa., showing a food mixer having a protective screen.

Product sheets of Ditto Sama showing food mixers with protective screens, Model No. BE.21, BE40, and BM40S.

A product sheet of Kemper, Guilford, Conn., showing a pair of food mixers each having a protective cover.

A product sheet of Nussex showing dough mixers which appear to have protective covers.

A cover to a product sheet of Tecnopast, Charlotte, N.C., showing a food mixer which appears to have a protective cover.

An advertisement of Kemper, Guilford, Conn., entitled, "The Original Spiral Mixer" from Modern Baking, May, 1992, p. 122., showing a food mixer having a protective screen.

A product sheet of Thunderbird Bakery Equipment showing a spiral mixer ARM–5080 having a protective screen.

A product sheet of Boku, entitled "Spiral Fast Mixer means Progress for you", showing a food mixer having a protective screen.

*Primary Examiner*—Timothy F. Simone
*Assistant Examiner*—James F. Hook
*Attorney, Agent, or Firm*—Fish & Richardson

[57] ABSTRACT

A food mixer includes a dual mount sensor arrangement which prevents operation of the mixer unless a protective safety guard is secured to the mounts. Each mount is physically spaced from each other so that a user must take extraordinary, and deliberate measures to circumvent the safety feature. The dual mount arrangement may be used in conjunction with a bowl lowering shut-off feature for disabling the mixer when the mixing bowl is lowered to a position where the user's safety is at risk.

14 Claims, 3 Drawing Sheets

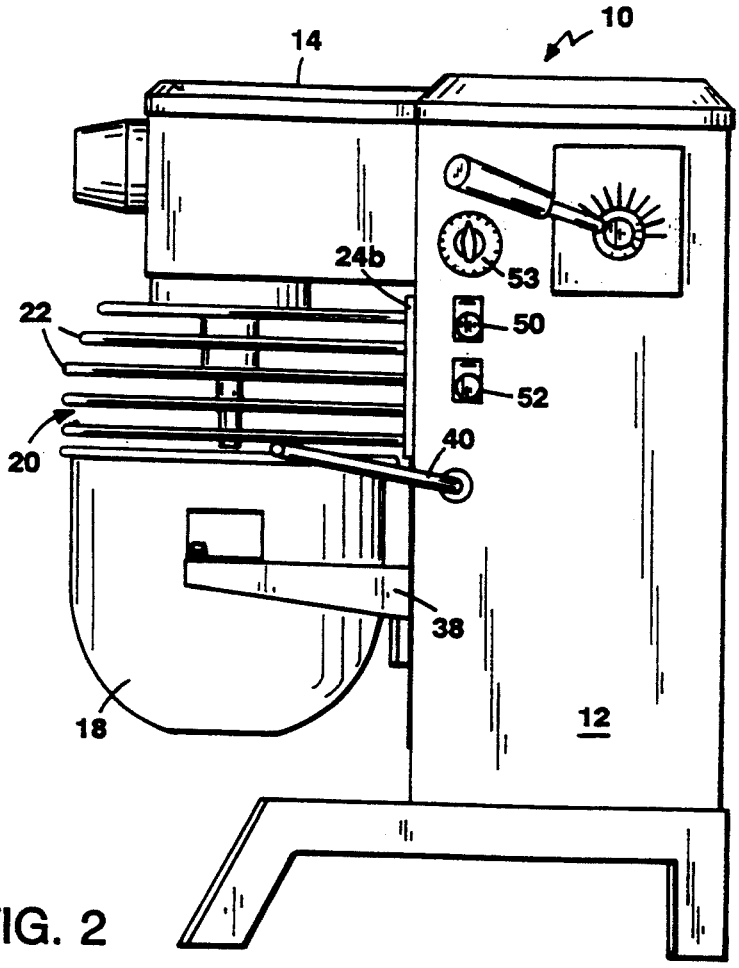
FIG. 2
FIG. 3
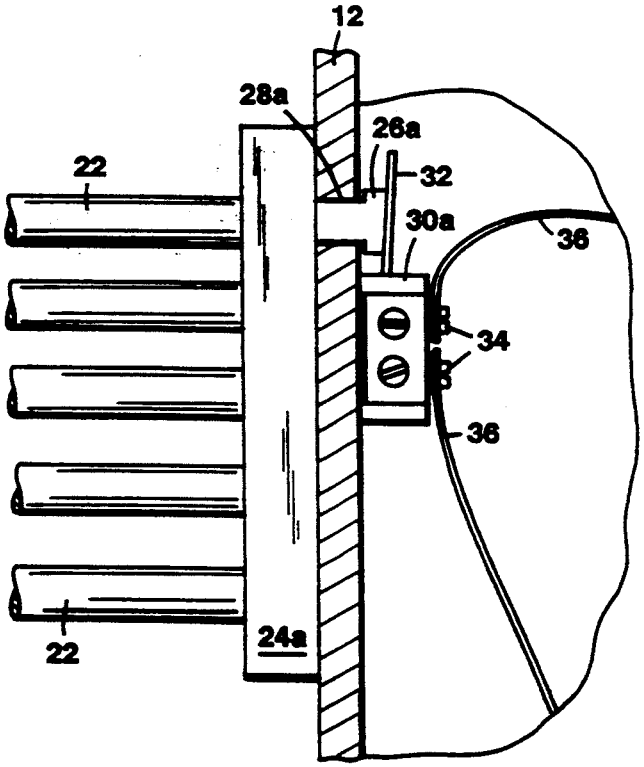

SAFETY GUARD SYSTEM FOR FOOD MIXER

BACKGROUND OF THE INVENTION

This invention relates to safety devices for food mixers.

In a food mixer, ingredients are placed within a container and are mixed by a mixing attachment, such as a beater driven by an electrical motor. Food mixers vary in size from domestic kitchen counter models to large industrial bakery mixers capable of mixing hundreds of pounds of ingredients in a single batch. An endless and ever-growing list of recipes make the mechanical mixer a commodity item wherever food products are sold and/or prepared. The growing demand for greater production, reduced labor, product consistency and freshness have created a marketplace for the many different sizes of food mixers. As the demand for production grows, so grows the size of the bowl, the various agitators (attachments), the motor horsepower, and the potential for accidental injury to the operator.

The size and power of food mixers used in these environments can cause severe injuries to operators who either accidentally or intentionally place parts of their body or clothing near the mixing attachment during operation. For this reason, safety devices, such as protective guards are sometimes used to shield an operator from placing his hands near the mixing attachments when the mixer is operating.

While it is true that the potential for accidental operator injury is greatly reduced with food mixers having safety devices, it still exists and is growing due to the increased utilization of unskilled and inadequately trained personnel. Further, where safety devices have been provided, their use is often disregarded. Food mixers having safety devices are often considered to be obstacles to operators who are either irresponsible or who are driven by output demands and schedules. Although the operator may appreciate the use of a safety device in reducing the risk of injury to himself, safety interests are often set aside in the interest of productivity and efficiency. On a typical day in a commercial bakery, an operator may be required to use a food mixer to mix the ingredients for a wide variety of recipes. The recipe may require that certain powdered or liquid ingredients be poured or folded into the mixture after the blending process has started. With such recipes, adding ingredients to the bowl becomes more difficult, particularly when the ingredients to be added are stored in large unwieldy containers or bags. Safety shields may obscure an operator's vision of the mixture as it develops within the bowl. Further, safety shields which are integrally affixed to the mixer increase the cost of the mixer as well as increase the overall difficulty in changing mixing agitators, removing the bowl, and cleaning the mixer. Operators working in such environments often ignore the use of safety devices and may even deliberately override a safety feature provided for his protection.

SUMMARY OF THE INVENTION

In general, in one aspect of the invention, the mixer includes a protective guard disposed over the container with a dual sensor mounting arrangement. The guard has at least two support members. The mixer further includes at least two mounts receiving corresponding ones of the support members of the protective guard and at least two sensors, each sensor corresponding to one of the mounts, to detect the presence of the corresponding support members in the mount. In the absence of either of the support members from the mounts, the corresponding sensor disables the drive system.

Embodiments of the invention include the following features. The protective guard is detachable from the mounts. Preferably the two drop-in mounts are spaced relative to each other by a distance more than the width of an adult human hand. The mixer further includes means for changing the relative spacing between the container and the protective guard, for example, a bowl lowering mechanism, such that with a first spacing (e.g., the bowl up position) a user's hands are effectively denied access to the mixing attachment and a sensor to detect that the relative spacing is the first spacing. Unless the relative spacing is the first spacing the sensor disables the drive system.

The invention prevents the mixer from being operated unless each of the support members of the protective guard are properly positioned within their corresponding mounts. By providing at least two support members with corresponding mounts and sensors, an operator is not able to use one hand to override the sensor with the other hand free and open to possible injury if placed in contact with the moving mixing attachment. In general, an operator is required to use extraordinary, deliberate measures to defeat the safety feature. At the same time, the guard offers minimum interference with the operator's legitimate need for access. The guard is easily and quickly detached when it needs to be cleaned or when a different attachment needs to be installed, and when bulk ingredients need to be added, the operator has three options: pouring them through the guard, opening a space between guard and bowl or detaching the guard altogether in one simple motion.

Other advantages and features of the invention will be apparent from the following description and from the claims.

BRIEF DESCRIPTION OF THE DRAWING

FIG. 2 is aside view of the mixer with the protective guard attached.

FIG. 3 is a cross-sectional view of a portion of the mixer taken along lines 3—3 of FIG. 1.

DESCRIPTION OF THE PREFERRED EMBODIMENT(S)

Figure 1:
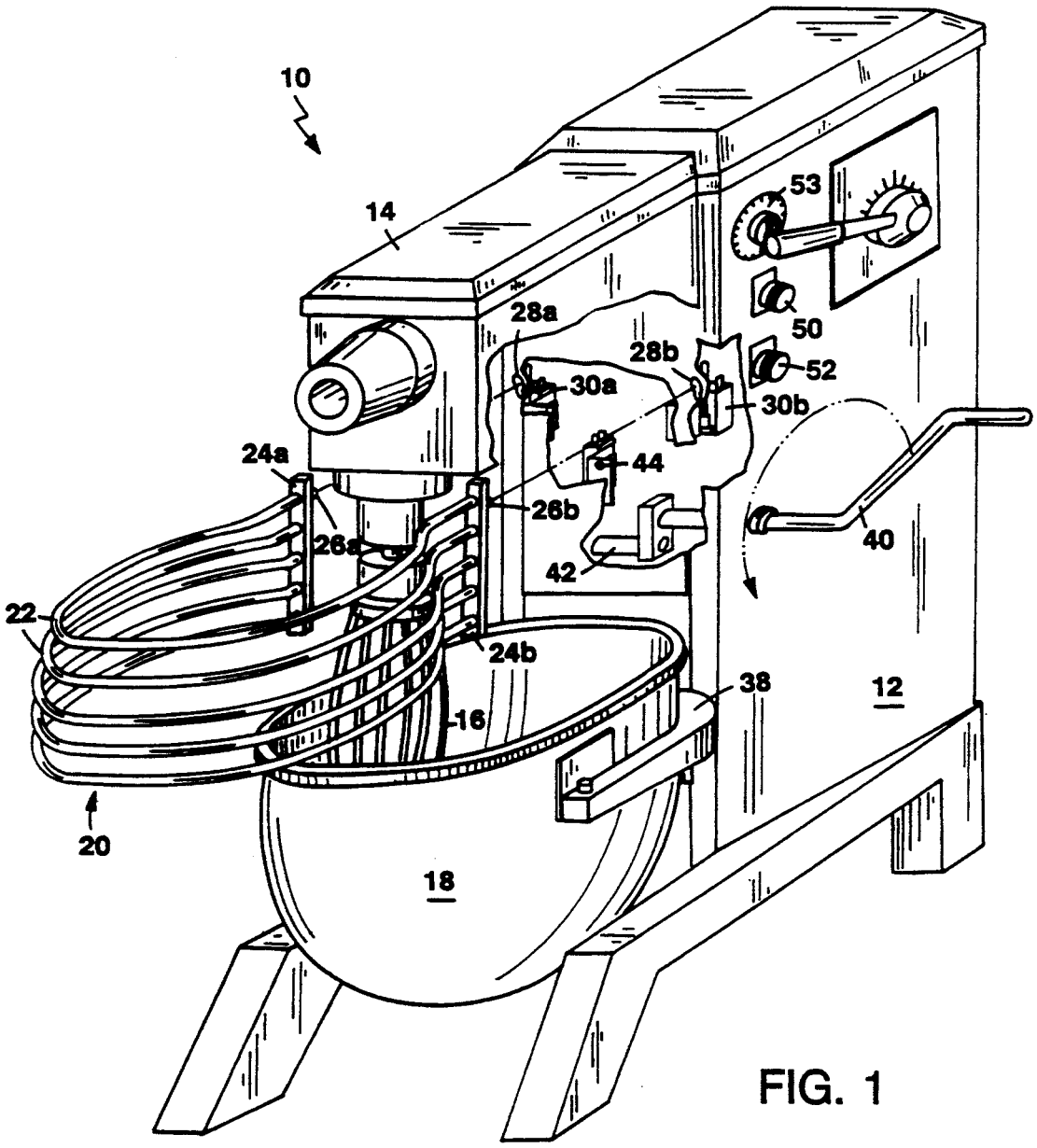
FIG. 1 is a perspective view, partially broken away, of a mixer having a protective safety guard.

As shown in FIGS. 1 and 2, a mixer 10, for example a Univex M20 Mixer available from Univex, Salem N.H., has a main housing 12 with a drive train enclosure 14 extending from an upper portion of the housing 12. The drive train enclosure encases a variable speed transmission that couples an electric motor (neither shown) to a mixing attachment 16. The mixing attachment 16 represents any one of a variety of whips, beaters, or dough hooks that work with food ingredients provided to a stainless steel bowl 18. A protective guard 20 having a number of cantilevered coaxial loops or open rings 22 is disposed over the bowl 18 and around mixing attachment 16 to limit access to the attachment and interior of the bowl during operation of the mixer 10. Each of the annular rings 22 is formed from a circular cross-section rod or tube and is fabricated from stainless steel so that the safety guard is without sharp edges. The smooth edges of the rings 22 facilitate handling and cleaning the guard 20. In addition, the spacing between the annular rings is sufficient for allowing a user to pour, for example powdered and liquid ingredients to the bowl through the guard while simultaneously preventing the passage of larger items, particularly human hands.

Each ring 22 has a pair of parallel legs which are connected respectively to a pair of parallel upright frame members 24*a*, 24*b*, each member having a headed support pin 26*a*, 26*b* for engaging corresponding keyholes 28*a*, 28*b* on the wall of the housing 12 facing the mixing attachment 16. The parallel legs of each ring 22 have chamfered ends which are slip-fit into corresponding thru holes disposed in frame members 24*a*, 24*b*. The legs are welded within the holes and the outer face of the frame members ground to provide a smooth outer surface. Each keyhole has a portion having a dimension sufficient for receiving the headed portion of the support pin and a slotted portion below the aperture for engaging the narrower shank of the pin. In this way, the support pins are mounted within the keyholes by placing the pins through the round apertures and lowering them into the slotted portions so that the heads are captured behind the wall and the frame members are flush against the outside wall. With this dual drop-in type arrangement, the protective guard 20, while firmly attached to the mixer, is easily detached from the mixer for cleaning or for replacing the attachment by simply lifting the guard upward until the headed portion is aligned with the keyholes 28*a*, 28*b* and then pulling outward.

A pair of electrical switches 30*a*, 30*b* are attached to the inner wall of the housing 12 behind corresponding keyholes 28*a*, 28*b* for sensing that the protective guard 20 is properly mounted to the housing. As will be discussed in greater detail in conjunction with FIG. 3, the electrical switches 30*a*, 30*b* are connected in series between the relay and power source requiring both switches to be closed for the mixer to be operational. Two switches are provided so that a user will generally be prevented from overriding the switches using one hand while having the other hand free to access the area near the mixing attachment without the guard properly in place. A user must go to inordinate lengths to activate both switches in a way that one of the user's hands is left unrestricted without the guard in place.

As shown in FIG. 3, support pin 26*a* is shown engaged within keyhole 28*a* so that the pin physically and electrically contacts an extending leaf member 32 extending from electrical switch 30*a*. The electrical switch 30*a* is a single-pole single-throw micro-switch having a pair of terminals 34 for receiving wires 36 connecting the relay to a power source.

The mixer has a mechanism for raising and lowering the bowl 18 in relation to the mixing attachment 16 and guard 20, as shown in FIGS. 1 and 2. The bowl 18 is supported by a pair of arms 38 that are mechanically connected to a handle 40 through a linkage (not shown) that translates rotational motion of the handle to vertical motion of the arms 38. The handle has a member, such as a cam 42 that when rotated contacts a third electrical switch 44 with the bowl 18 in the raised and generally inaccessible operating position. The third switch 44 is connected in series with switches 30*a*, 30*b* so that the mixer is operational only when the guard is properly mounted and the bowl is raised.

Figure 4:
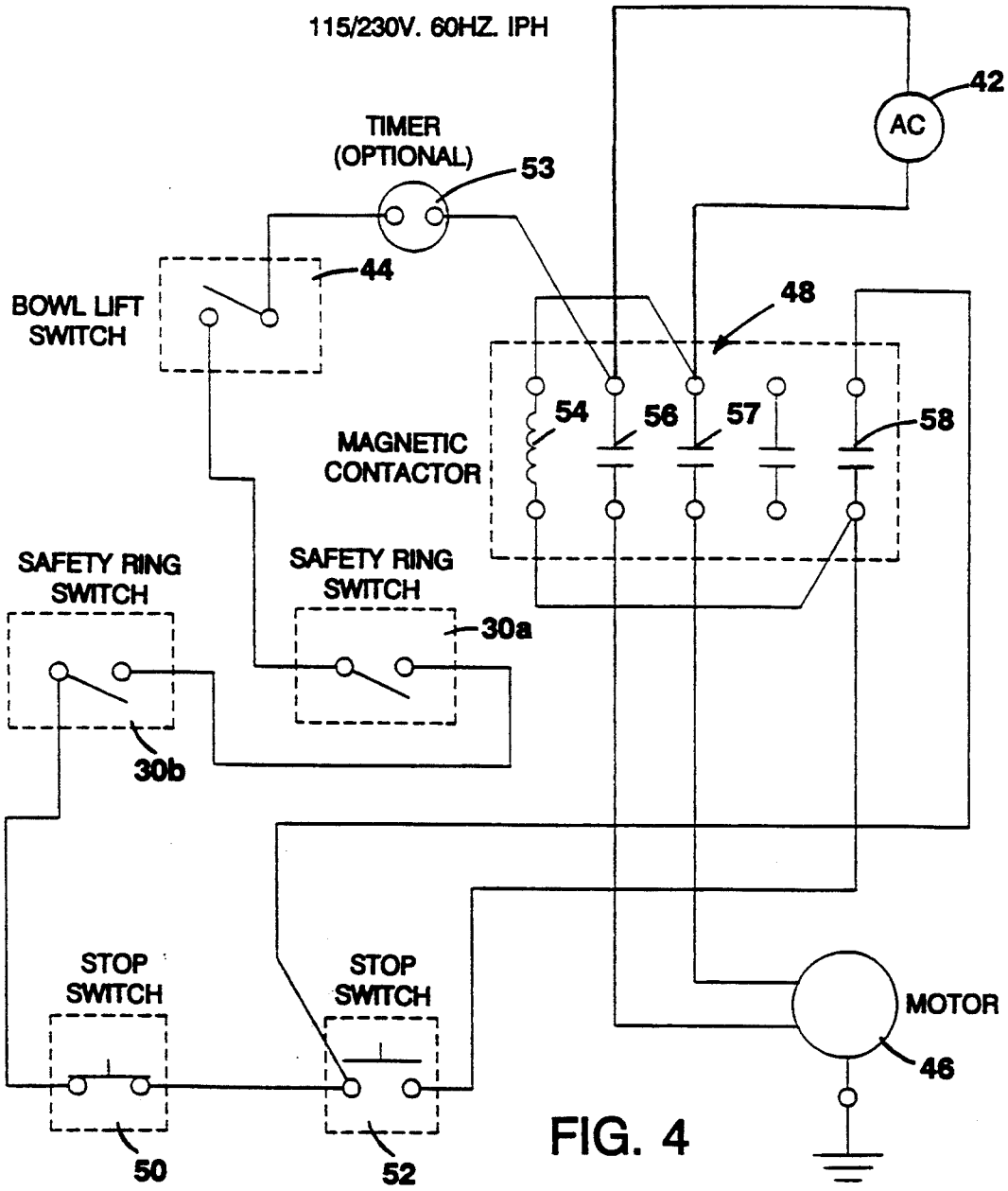
FIG. 4 is a schematic representation of the electrical circuit of the mixer.

In the electrical circuitry diagrammed in FIG. 4, an AC power source 42 is connected to an electrical motor 46 through a controller preferably in the form of a magnetic contact relay 48 actuated by the bowl lift switch 44, the pair of protective guard switches 30*a*, 30*b*, stop switch 50, start switch 52, and optional timer switch 53 all of which are connected in series. Electrical current is supplied to the motor when the series connected switches are closed and is discontinued if any one of the switches is opened. The contact relay 48 has a relatively high isolation characteristic between its control input (the coil 54) and its output (the contacts 56) so that a relatively small amount of current flowing through the switches controls the higher amount of current needed to drive the motor 46.

To operate mixer 10, the bowl 18 is placed in the raised position and the guard 20 attached to the mixer 10, causing switches 30*a*, 30*b* and 44 to be closed. With stop switch 50 being normally closed, start switch 52 is depressed. A full series connection via contact relay circuit 48 causes normally open contacts 56 to close. In addition to motor contacts 56, 57 being closed, contact 58 also is closed so that start switch 52 is shorted to maintain a continuous circuit after it has been released. Thus energized, the motor 46 drives the attachment head to begin blending the mixture within bowl 18. If during the mixing operation, the guard 20 is removed or the bowl 18 is lowered, coil circuit 54 is opened, deenergizing the relay circuit 48 and causing motor 46 to stop. Similarly, with the guard 20 detached or the bowl 18 lowered, motor 46 cannot be started even though start switch 52 is depressed.

An optional timer switch 53 is provided to permit a user to set the time of a desired mixing operation. When the set time has elapsed, operation of the mixer is automatically stopped. However, the use of timer switch 53 is independent of start switch 52 and does not allow the mixer 10 to be operated by solely setting the timer 53. Use of the timer 53 still requires that the start switch 52 be depressed to operate the mixer.

While a preferred embodiment has been described, other variations and modifications are within the scope of the following claims. For example, suitable alternative mounts such as twin drop-in brackets for attaching the protective guard to the housing may be substituted. Also, the kinds of proximity sensors, such as magnetic contact switches may be used for sensing the presence of the protective guard within the keyholes. A magnetic field could be required to close the switches and would make overriding the safety feature even more difficult.

What is claimed is:

1. A food mixer, comprising:

a housing;

a drive train enclosure mounted to and extending from an upper portion of the housing;

a removable bowl for holding ingredients to be blended;

a bowl support to support the removable bowl below the drive train enclosure:

a motor;

at least two mounts positioned on the housing more than a hand width apart from each other so that said two mounts cannot be contacted simultaneously by the same hand;

a detachable protective guard, positioned between the drive train enclosure and the removable bowl, the guard having a structure for blocking hand access to said bowl when supported within the bowl support, and having at least two support members each arranged to engage an associated one of said mounts such that the guard is cantilevered from said mounts over said bowl, said protective guard being capable of manual detachment from said mounts solely by manipulating the detachable guard itself;

a mixing attachment driven by said motor, said attachment extending downward from the drive train enclosure, through said protective guard, and into the removable bowl to blend the ingredients in the bowl;

at least two sensors, each sensor associated with a respective one of said at least two mounts, to detect the engagement of said support members and said mounts; and a controller responsive to said sensors for deactivating said motor when either of said support members is disengaged from the associated one of said mounts.

2. The mixer of claim 1 further comprising:

means for changing the relative spacing between said container and said protective guard such that with a first spacing a user is denied access to said mixing attachment; and a third sensor to detect that said relative spacing is said first spacing; and said controller being responsive to said third sensor for disabling said drive system unless said relative spacing is said first spacing.

3. The mixer of claim 2 wherein said protective guard has voided portions with dimensions affording access sufficient for introducing said ingredients into said container through said guard but insufficient to permit the passage of a human hand, said relative spacing being said first spacing.

4. The mixer of claim 2 wherein said means for changing the relative spacing to said first spacing causes said container to move upwardly relative to the guard.

5. The mixer of claim 1 wherein said sensors comprise electrical switches connected in series.

6. The mixer of claim 5 wherein said support members comprise protuberances and said mounts include mating apertures, engagement of said protuberances within said mating apertures closing said electrical switches.

7. The mixer of claim 5 wherein said controller includes a relay connected to activate said drive system, said switches being connected in series with said relay.

8. The mixer of claim 1 wherein said sensors are non-contacting switches.

9. The mixer of claim 8 wherein said non-contacting switches are magnetic switches.

10. A food mixer, comprising:

a housing;

a drive train enclosure mounted to and extending from an upper portion of the housing;

a removable bowl for holding ingredients to be blended;

a bowl support to support the removable bowl below the drive train enclosure;

a motor;

at least two mounts positioned on the housing more than a hand width apart from each other so that said two mounts cannot be contacted simultaneously by the same hand;

a detachable protective guard, positioned between the drive train enclosure and the removable bowl, the guard having a structure for blocking hand access to said container when supported within the bowl support and having at least two support members each arranged to engage an associated one of said mounts such that the guard is cantilevered from said mounts over said bowl, said protective guard being capable of manual detachment from said mounts solely by manipulating the detachable guard itself;

a mixing attachment driven by said motor, said attachment extending downward from the drive train enclosure, through said protective guard, and into the removable bowl to blend the ingredients in the bowl;

independent first and second means for detecting the engagement of said pair of support members and said mounts, respectively;

means for changing the relative spacing between said bowl and said protective guard such that with a first spacing a user is denied hand access to said mixing attachment;

third means independent from said first and second means for detecting that said relative spacing is said first spacing; and a controller responsive to said first, second and third means to deactivate said motor when either of said support members is disengaged from said mounts or when said relative spacing is not said first spacing.

11. The mixer of claim 10 wherein said at least two mounts comprise dual drop-in mounts.

12. The mixer of claim 10 wherein said support members comprise headed pins and said mounts include mating apertures, engagement of said headed pins within said apertures activating said first and second means for detecting the presence of said support members.

13. The mixer of claim 10 wherein said protective guard is manually detachable to permit replacement of said mixing attachment or to clean said guard.

14. A food mixer, comprising:

a housing;

a drive train enclosure mounted to and extending from an upper portion of the housing;

a removable bowl for holding ingredients to be blended;

a bowl support to support the removable bowl below the drive train enclosure;

a motor;

at least two mounts positioned on the housing more than a hand width apart from each other so that said two mounts cannot be contacted simultaneously by the same hand a detachable protective guard, positioned between the drive train enclosure and the removable bowl, the guard having a structure for blocking hand access to said bowl when supported within the housing, having at least two support members each arranged to engage an associated one of said mounts such that the guard is cantilevered from said mounts over said container, said protective guard being capable of manual detachment from said mounts solely by manipulating the detachable guard itself;

a mixing attachment driven by said motor, said attachment extending downward from the drive train enclosure, through said protective guard, and into the removable bowl to blend the ingredients in the bowl;

a first sensor, associated with a first one of said pair of mounts, to detect the engagement of a first one of said support members and said mount; and a second sensor, associated with a second one of said pair of mounts, to detect the presence of a second one of said support members in said mount to support said guard on said housing in position over said bowl;

means for changing the relative spacing between said bowl and said protective guard such that with a first spacing a user is denied access to said mixing attachment;

a third sensor to detect that said relative spacing is said first spacing; said first, second and third sensors each being independent of the other two sensors, and a controller responsive to said first, second and third sensors to deactivate said motor when either of said pair of support members is disengaged from said mounts or when said relative spacing is not said first spacing.

* * * * *